US006261086B1

(12) United States Patent
Fu

(10) Patent No.: US 6,261,086 B1
(45) Date of Patent: Jul. 17, 2001

(54) FLAME DETECTOR BASED ON REAL-TIME HIGH-ORDER STATISTICS

(75) Inventor: Zhizhen Fu, Carrollton, TX (US)

(73) Assignee: Forney Corporation, Carrollton, TX (US)

( * ) Notice: Subject to any disclaimer, the term of this patent is extended or adjusted under 35 U.S.C. 154(b) by 0 days.

(21) Appl. No.: 09/565,484

(22) Filed: May 5, 2000

(51) Int. Cl.[7] ..... F23N 5/08
(52) U.S. Cl. ..... 431/79; 340/578; 250/554
(58) Field of Search ..... 431/79, 14, 75, 431/78, 77; 342/90, 22; 340/578, 577, 579; 250/554

(56) References Cited

U.S. PATENT DOCUMENTS

| | | | | |
|---|---|---|---|---|
| 3,940,753 | | 2/1976 | Muller . | |
| 4,280,184 | | 7/1981 | Weiner et al. . | |
| 4,322,723 | | 3/1982 | Chase . | |
| 4,370,557 | | 1/1983 | Axmark et al. . | |
| 4,553,031 | | 11/1985 | Cholin et al. . | |
| 4,665,390 | | 5/1987 | Kern et al. . | |
| 4,750,142 | | 6/1988 | Akiba et al. . | |
| 4,783,592 | | 11/1988 | Snider et al. . | |
| 4,800,285 | | 1/1989 | Akiba et al. . | |
| 4,904,986 | | 2/1990 | Pinckaers . | |
| 5,073,769 | | 12/1991 | Kompelien . | |
| 5,077,550 | | 12/1991 | Cormier . | |
| 5,091,890 | * | 2/1992 | Dwyer | 367/904 |
| 5,126,721 | | 6/1992 | Butcher et al. . | |
| 5,337,053 | * | 8/1994 | Dwyer | 367/904 |
| 5,495,112 | | 2/1996 | Maloney et al. . | |
| 5,497,004 | | 3/1996 | Rudolph et al. . | |
| 5,547,369 | | 8/1996 | Sohma et al. . | |
| 5,993,194 | * | 11/1999 | Lemelson et al. | 431/79 |

FOREIGN PATENT DOCUMENTS

WO 98/24192 * 6/1998 (WO) .

OTHER PUBLICATIONS

Zhi–Zhen Fu, "Non–Minimum Phase ARMA System Identification Via an Orthogonal Search and Higher–Order Statistics," submitted to The Wichita State University, Apr., 1992.

* cited by examiner

*Primary Examiner*—Marvin M. Lateef
*Assistant Examiner*—Josiah C. Cocks
(74) *Attorney, Agent, or Firm*—Locke Liddell & Sapp LLP

(57) ABSTRACT

A method, and a system for implementing the method, for detecting whether a flame is an on state or alternatively is in an off state. The method includes (i) detecting the flame and generating therefrom a flame signal capturing one or more attributes of the flame; (ii) using a high-order cumulant-to-moment formula to determine high-order cumulants for a random variable process representation of the flame signal; and (iii) determining whether the flame is on or off using the high-order cumulants. The method includes the step of applying the high-order cumulant-to-moment formula in a self-learning algorithm to determine flame-on high-order cumulants and flame-off high-order cumulants for the flame. Step (iii) includes comparing the high-order cumulants to the flame-on high-order cumulants and the flame-off high-order cumulants to determine whether the status of the flame is on or off.

20 Claims, 6 Drawing Sheets

| 502 TESTS | 504 TARGET SIDE-BURNER 10B | 506 TARGET MID-BURNER 10A | 508 ADJACENT BURNER 9B | 510 ADJACENT BURNER 9A |
|---|---|---|---|---|
| TEST 1. | OIL ON<br>TEST RESULT: 161 | OIL ON<br>TEST RESULT: 355 | OIL ON | OIL ON |
| TEST 2. | OFF<br>TEST RESULT: 0.79 | OFF<br>TEST RESULT: 13.11 | OIL ON | OIL ON |
| TEST 3. | OIL ON<br>TEST RESULT: 108 | OIL ON<br>TEST RESULT: 437 | GAS ON | GAS ON |
| TEST 4. | OFF<br>TEST RESULT: 0.72 | OFF<br>TEST RESULT: 2.06 | GAS ON | GAS ON |

FLAME DETECTOR BASED ON REAL-TIME HIGH-ORDER STATISTICS

BACKGROUND OF THE INVENTION

1. Field of the Invention

The following invention relates generally to flame detectors, and specifically to automated and programmable flame detectors.

2. Related Art

Boilers are used commercially to provide power for various commercial facilities. The commercial facilities can include anything from an office building, to larger facilities, such as power plants and paper mills.

A typical boiler will draw in hot water, boil it, and generate steam. The steam can be used, for example, to generate electrical power by pushing a steam turbine. The boiler, itself, is powered by a burner or burners. The burner is a device that combusts fuels, such as oil, gas, or coal.

In commercial facilities, particularly larger boilers, there are many burners operating side by side, up and bottom, and corner to corner to combust the fuels. Some boilers can have up to 64 burners operating at the same time. More complex facilities have a Burner Management System (BMS), which includes a safety system to prevent hazard, as well as a control system, to accurately control the temperature of the boiler. Depending upon the "loading conditions," which refers to the usage requirements, it is possible to turn on the burners selectively. For lower loading, most burners may be kept off, whereas for higher loading, it is possible to turn most or all burners on. The desired state is for the control system to keep on only the exact number of burners required for a particular loading condition, to maintain usage efficiency and to prevent hazard.

It is important to know if a burner is on or off at any given time to maintain proper control of the fuel supply to this burner for the whole boiler. For example, it is important to determine if a burner has been properly shut off. Direct observation is not likely convenient, and is likely inefficient or altogether impossible for multiple burners in one boiler. The burners operate at very high temperatures, making direct observation difficult. The fact that there are numerous burners, operating side by side, makes this task impossible. Moreover, in an automated system (for example, a modem burner management system), it is preferable to have the on/off conditions of the burners measured automatically, without human intervention, to save time and expense, and add other efficiencies. For this reason, commercial burners have flame detector devices to determine burner on/off conditions automatically.

The control system for most conventional flame detector devices use electrical circuitry to determine whether the burner flame is on or off based on pulse per second (PPS) measurement. An electrical circuit with an RC time constant (where R is resistance, and C is capacitance) is observed for a charge/discharge of capacitance, to produce PPS. Based on the PPS it is determined whether the flame is on or off. Unfortunately, these devices do not perform as well as desired, because they have slow associated operational timing, and limited accuracy, that means sometimes they report wrong flame conditions.

One type microprocessor/microcontroller based of flame detector device includes a photosensor device located near the targeted burner to detect the wavelengths of radiation emitted from the combustion and convert it to be an electrical signal. The signal is fed by a fiber optic cable to a receiving device. An amplifier in the receiving device amplifies the signal, and feeds it to a microprocessor/microcontroller device, which must determine from the detected radiation whether the burner is on or off. Each burner may have its own photodetector device, including a photosensor device and associated detection components.

Unfortunately, since a number of burners must operate side by side, it is often difficult to detect whether a particular burner is on or off. The reason is that the adjacent burners add background signal (or called background "noise") to the wavelengths of radiation detected from a particular burner (target burner). This background signal can cause a burner to be detected as being on, whereas it is actually off, or vice versa. The problem is particularly perplexing because several burners can contribute background signal to the target burner, and also because adjacent burners may burn different types of fuel to make background signal more complex.

There are also additional types of noises referred to as Gaussian noises, which make burner on/off condition detection difficult. Noise contributors taking a Gaussian distribution include noises caused by electrical devices in the environment and the temperatures of devices in the associated environment. Gaussian noises are wide band noises sometimes called white noise, which means they occur over the range of electromagnetic frequencies, and are not isolated to particular frequency ranges. This makes their removal difficult through conventional filters, because it is not possible to remove them with low pass, band pass, or high pass analog, even digital filters.

What is needed is a flame detector that more accurately detects burner on/off conditions by removing the associated noises, including noises from adjacent burners as well as background noises.

SUMMARY OF THE INVENTION

The present invention is directed to a method, and a system for implementing the method, for detecting whether a flame is an on state or alternatively is in an off state. The method includes (i) detecting the flame and generating therefrom a flame signal capturing one or more attributes of the flame; (ii) using a high-order cumulant-to-moment formula to determine high-order cumulants for a random variable process representation of the flame signal; and (iii) determining whether the flame is on or off using high-order cumulants.

The method includes the step of applying the high-order cumulant-to-moment formula in a self-learning algorithm to determine flame-on high-order cumulants and flame-off high-order-cumulants for the flame. This includes detecting a second flame signal, wherein an on or off status of a flame from which the second flame signal is obtained is known and utilized as a reference for detection processing. All analog flame signals must be converted to be digital flame signals through an Analog-to-Digital Converter (ADC), and using a Digital Signal Processor (DSP) microprocessor to calculate the flame-on high-order cumulants and the flame-off high-order cumulants from the digitized form flame signal.

Step (i) can include: detecting the flame signal wherein an on or off status of the flame is unknown; and converting the flame signal from an analog form flame signal to a digitized form flame signal. Detecting of the flame signal can include optically detecting wavelengths of radiation emitted by the flame.

Step (ii) can include calculating the high-order cumulants from the digitized form flame signal in Digital Signal Processor (DSP) microprocessor.

Step (iii) can include comparing the high-order cumulants to the flame-on high-order cumulants and the flame-off high-order cumulants, which are previously detected, calculated, and stored in the DSP microprocessor, to determine whether the status of the flame is on or off. This includes, for example, determining one or more threshold cumulants located between the flame-on high-order cumulants and the flame-off high-order cumulants; and comparing the high-order cumulants to the one or more threshold cumulants to determine whether the status of the flame is on or off.

In one embodiment, the cumulant-to-moment formula is represented by the equation:

$$c(x_1, \ldots, x_K) = \sum_p (-1)^{n_p-1}(n_p-1)!E\left\{\prod_{i\epsilon g_1^p} X_i\right\} \ldots E\left\{\prod_{i\epsilon g_{n_p}^p} X_i\right\}.$$

Here, $c(x_1, \ldots, x_k)$ represents cumulants, $(x_1, \ldots, x_k)$ represent k discrete (digital) random variables, p represents partitions, $n_p$ represents the number of groups in the specific partition, E{ } represents an expectation, i represents an integer, $X_i$ represents the ith random process, g represents a group in one specific partition, and $g_i^p$ through $g_{n_p}^p$ represent the ith through the $n_p$th partition groups.

The above process can be used, for example, where the flame arises from combustion of a fuel in a burner associated with a boiler, and where the fuel includes oil fuel, gas fuel, or coal fuel.

It will be understood by those skilled in the relevant all that various changes in form and details may be made therein without departing from the spirit and scope of the invention.

BRIEF DESCRIPTION OF THE FIGURES

The present invention will be described with reference to the accompanying drawings, wherein:

FIGS. 6A and 6B illustrate the cumulant spectrums for an experimental oil burner respectively turned on and off, with oil burners adjacent to it turned on; and FIGS. 7A and 7B illustrate the cumulant spectrums for an experimental oil burner respectively turned on and off, with gas burners adjacent to it turned on.

In the figures, like reference numbers generally indicate identical, functionally similar, and/or structurally similar elements. The figure in which an element first appears is indicated by the leftmost digit(s) in the reference number.

DETAILED DESCRIPTION OF THE PREFERRED EMBODIMENTS

In the following description of the preferred embodiments, reference is made to the accompanying drawings which form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

The present invention is directed to detecting the flame on/off conditions of a target burner, which the flame detector device monitors. In other words, the invention is directed to determining whether the flame of a target burner is on or off. In the exemplary embodiment, the flame detector uses photoreception of radiation wavelengths emitted from combustion in a burner to determine whether the burner is on or off. Those skilled in the art will recognize, however, that the principles of the present invention can be used in various other reception devices, and related environments without departing from the scope of the present invention.

Figures 1, 5:
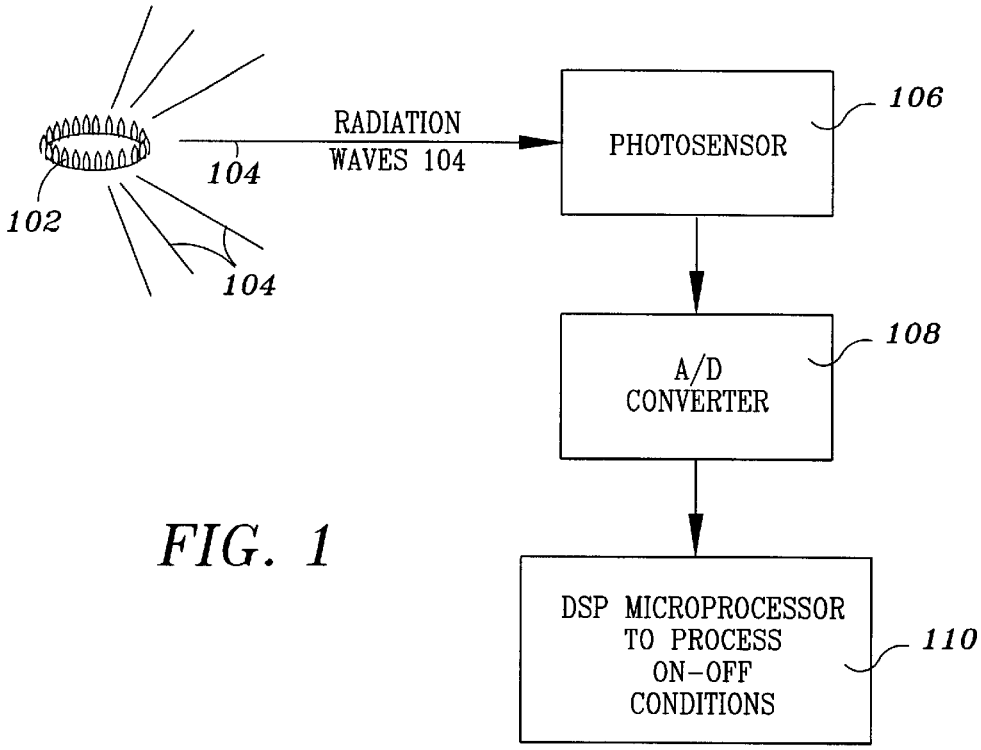
FIG. 1 is a block diagram illustrating how data from the radiation waves are recorded.
FIG. 5 illustrates empirical results for a flame detection apparatus.

FIG. 1 is a block diagram illustrating how data from the radiation waves are recorded. FIG. 1 includes burner 110 (positioned in a boiler apparatus), electromagnetic radiation in the form of radiation waves 104, photosensor device 106, analog/digital converter 108, and DSP microprocessor to process on/off variables 110. Burner 102, which burns for example gas, oil, or conventional fuels, emits radiation waves. The radiation waves 104 are detected by photosensor 106. In one embodiment, the radiation waves detected are specifically 10O ultraviolet and infrared radiation waves portions of the optical spectrum. The photosensor passes the detected signals in analog form to analog/digital converter 108, which digitizes the signal. From the digitized signal, on-off conditions 110 are detected and processed by DSP microprocessor for flame conditions.

Figure 2A:
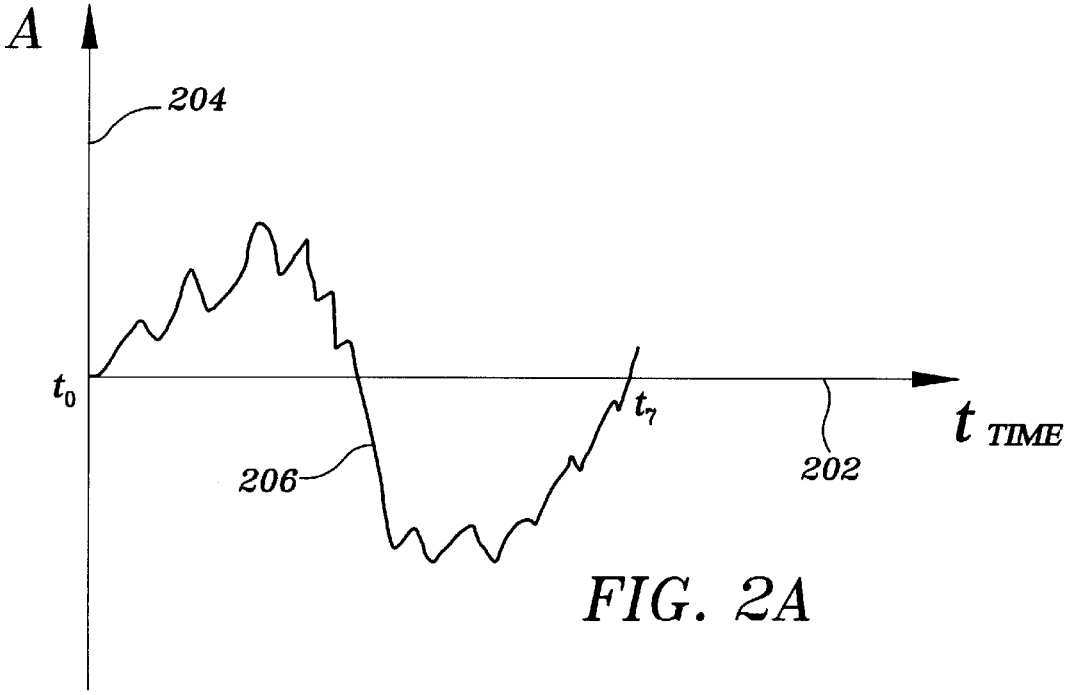
FIGS. 2A and 2B illustrated the workings of analog/digital converter.
Figure 2B:
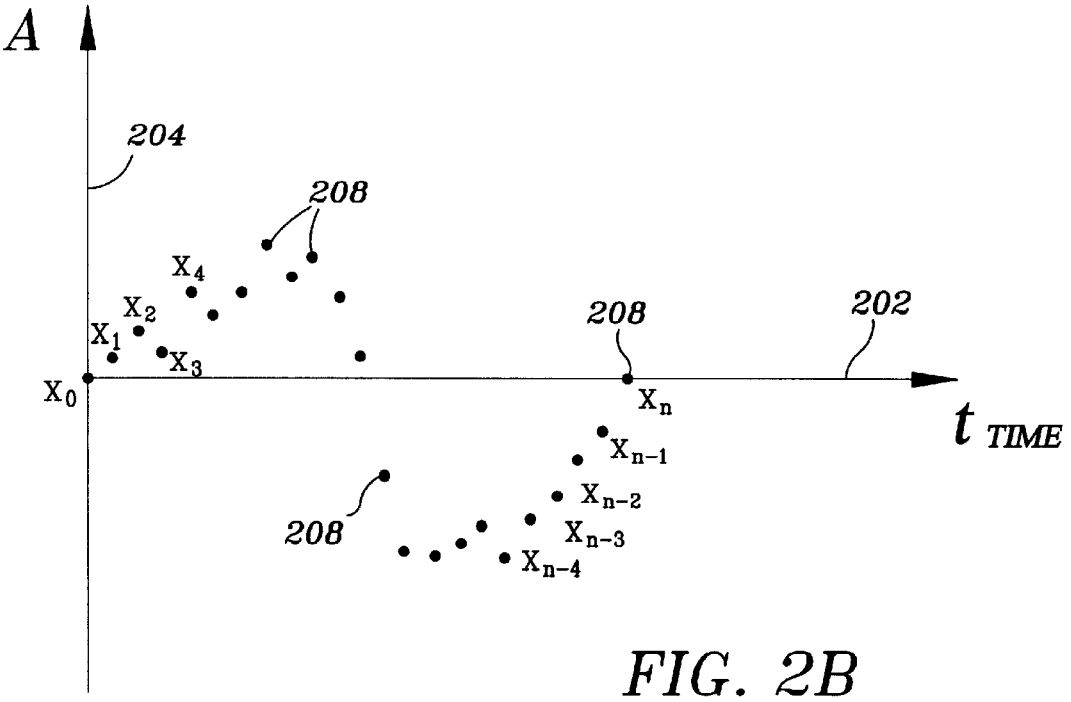

FIGS. 2A and 2B illustrated the workings of analog/digital converter 108. FIG. 2A illustrates an exemplary relationship time and amplitude for an analog signal. The amplitude 204 of the signal is plotted as ordinate, the time 202 in seconds is plotted as abscissa. The analog signal is plotted to take on continuous values between time $t=t_0$ and $t=t_T$. Similarly, FIG. 2B illustrates an exemplary relationship time and amplitude for a digitized version of signal 206, whose points are labeled 208. In FIG. 2A, the time values have been symbolized discretely by $t=t_0$ through $t=t_T$. Whether the entire signal 206 is captured by the discretized signal sequence: $x_0, x_1, x_2 \ldots x_n$ 208 depends upon how many intermediate values for the amplitude of the signal are taken between $t=t_0$ and $t=t_T$. In the frequency domain, the frequency is equal to the inverse of the time, such that the frequency at $t=t_T$ equals $1/t_T$. The analog signal is sampled at two times (or greater) the maximum frequency value, to meet the Nyquist theory, the entire signal 206 should be captured.

In an example embodiment, the intervals between time values $t_0$ and $t_1$ are 1 millisecond intervals, so that ($t_0$, $t_1=t_0+0.001=0.001$, $t_2=t_1+0.001=0.002$, . . ). In this embodiment, one thousand points are taken as $x_0$, $x_1$, $x_2 \ldots x_{999}$.

In this embodiment, on-off conditions 110 are calculated by one or more digital signal processors (DSPs). The on-off conditions are derived by use of high-order statistics (HOS). The first-order and second-order cumulants work to describe a signal if the signal has a Gaussian (Normal) probability density function (PDF). However, many signals are not Gaussian, so they do not have a Gaussian PDF. This includes the emissions from a combustion, which does not follow a Gaussian PDF. But in the most cases, the noises associated with the temperature and electrical environment of the burner are Gaussian noises because they do follow a Gaussian PDF. Nor can these noises be easily removed because they are wide band (white noise), meaning they are not localized to particular frequencies where a low-pass, band-pass, or high-pass filter could remove them.

Recent advances in the theory of real-time series and in the signal processing field make the present invention possible. In part this is due to the introduction of probabilistic ideas into what was formerly treated deterministically; in part it is attributable to the power of high-technology electronic computer which has removed the obstacles imposed by the extensive and tedious calculations involved in most real-time series researches and applications.

The following is an explanation of the use of HOS in the present invention, beginning with basic probability concepts.

The characteristic function $\Phi_x(\omega)$ of a random variable (r.v.) x is defined as follows:

$$\Phi_x(\omega) \equiv E\{e^{j\omega x}\} = \int_{-\infty}^{\infty} e^{j\omega x} f(x)\,dx,$$

where f(x) is the probability density function of x. Because the kth-order derivative of $\Phi_x(\omega)$ with respect to ω is $$\Phi_x^{(k)}(\omega) = j^k \int_{-\infty}^{\infty} x^k e^{j\omega x} f(x)\,dx, \quad \text{and}$$

$$\Phi_x^{(k)}(0) = j^k \int_{-\infty}^{\infty} x^k f(x)\,dx = j^k E\{x^k\}$$

one can readily show that a Taylor series expansion of $\Phi_x(\omega)$ around 0 is as follows, if all absolute moments of r.v. x exist:

$$\Phi_x(\omega) = \sum_{k=0}^{\infty} m_x^{(k)} \frac{(j\omega)^k}{k!}, \quad \text{where}$$

$$m_x^{(k)} = E\{x^k\} \equiv \int_{-\infty}^{\infty} x^k f(x)\,dx,$$

denotes the kth-order moment of r.v. x.

The Taylor's series expansion of $\ln\Phi_x(\omega)$ around 0 is considered below:

$$\ln\Phi_x(\omega) = \sum_{-\infty}^{\infty} c_x^{(k)} \frac{(j\omega)^k}{k!}$$

where $c_x^{(k)}$ is defined as the kth-order cumulant of r.v. x. The relationship between the moments and cumulants is displayed below for k=0, 1, 2, 3 as follows For $k=0$, $c_x^{(0)}=0$.

For $k=1$, $c_x^{(1)}=m_x^{(1)}=E\{x\}$.

For $k=2$, $c_x^{(2)}=m_x^{(2)}-[m_x^{(1)}]^2=\sigma_x^2$, where $E\{x\}$ is the mean of the r.v. x and $\sigma_x^2$ is the variance of the r.v. x.

For $k=3$, $c_x^{(3)}=m_x^{(3)}-3m_x^{(1)}m_x^{(2)}+2[m_x^{(1)}]^3$.

It is clear that the above equations present the relationship between the moments and cumulants of a r.v. for k=0, 1, 2, 3. Later, the general relationship between the joint kth-order cumulants and moments of a r.p. are considered.

If x is a Gaussian distribution r.v., with mean m and variance $\sigma_x^2$, then:

$$\Phi_x(\omega) = e^{j\omega m - \sigma^2 \frac{\omega^2}{2}}.$$

Taking logarithms of both sides and comparing with the above equations for k=0, 1, 2, 3 shows change "$c_x^{(10)}$" with $c_x^{(0)}$. =0, $c_x^{(1)}$=m, $c_x^{(2)}=\sigma_x^2$, $c_x^{(k)}$=0 for all k>2 in the case of the Gaussian Distribution. Therefore, dealing with higher-order statistics must be limited to the non-Gaussian case.

The above definition may be extended to a random vector $\underline{x}=(x_1, \ldots, x_k)^T$. Assuming that all absolute moments of appropriate order exist for every $x_i$, i=1, 2, . . . , k, then the joint moments of the random vector $\underline{x}$ can be defined as follows:

$$m_{\underline{x}}^{(\mu_1, \ldots, \mu_k)} = E\{x_1^{m_1} \ldots x_k^{m_k}\},$$

where $\mu_i$, i=1, 2, . . . , k, are integers.

If $\Phi_{\underline{x}}(\underline{\omega})$ denotes the joint characteristic function of $\underline{x}$, then, its Taylor series expansion about the origin takes the form $$\Phi_{\underline{x}}(\omega_1, \ldots, \omega_k) = \Phi_{\underline{x}}(\underline{\omega}) = E\left\{e^{j\underline{\omega}^T \underline{x}}\right\}$$

$$= \sum_{\mu_1+\ldots+\mu_k \le n} \frac{j^{\mu_1+\ldots+\mu_k}}{\mu_1!\ldots\mu_k!} m_{\underline{x}}^{(\mu_1, \ldots, \mu_k)} \omega_1^{\mu} \ldots \omega_k^{\mu_k} + O(|\omega|^n).$$

where $\underline{\omega}=(\omega_1, \ldots \omega_k)^T$ is a vector and $O(|\omega|^n)$ denotes the higher-order part of this expansion with $|\omega|=|\omega_1|+\ldots+|\omega_k|$ and $$\sum_{\mu_1+\ldots+\mu_k \le n}$$

is taken over all non-negative $\mu_1, \ldots, \mu_k$ whose sum does not exceed n.

The kth-dimensional function $\ln\Phi_{\underline{x}}(\omega)$ may also be expanded in the Taylor series about the origin as follows $$\ln\Phi_{\underline{x}}(w) = \sum_{m_1+\ldots+m_k \le n} \frac{j^{m_1+\ldots+m_k}}{m_1!\ldots m_k!} c_{\underline{x}}^{(m_1, \ldots, m_k)} w_1^{m_1} \ldots w_k^{m_k} + O(|w|^n),$$

where $$c_{\underline{x}}^{(\mu_1, \ldots, \mu_k)} = \left[\frac{\partial^{\mu_1+\ldots+\mu_k}}{\partial\omega_1^{\mu_1}\ldots\partial\omega_k^{\mu_k}} \ln\Phi_{\underline{x}}(\underline{\omega})\right]_{|\omega|=0}$$

denotes the joint cumulant of the random vector $\underline{x}$ which is the partial derivatives of $\ln\Phi_{\underline{x}}(\omega)$ with respect to vector $\underline{\omega}$. (Note that $c_{\underline{x}}^{(\mu_1, \ldots, \mu_k)}$ are also called semi-variants.)

Expanding the function $e^{\ln\Phi_{\underline{x}}(\omega)}$ using the above equation, and comparing the coefficients with a former equation, it is possible to find the relationship between higher-order moments, $m_{\underline{x}}^{(\mu_1, \ldots, \mu_k)}$, and cumulants $c_{\underline{x}}^{(\mu_1, \ldots, \mu_k k)}$.

Similarly, expanding $\ln\Phi_{\underline{x}}(\underline{\omega})$ and comparing coefficients with a former equation, an expression of $c_{\underline{x}}^{(\mu_1, \ldots, \mu_k)}$ can be presented as a function of $m_{\underline{x}}^{(\mu_1, \ldots, \mu_k)}$.

Instead of presenting these complicated relationships, the simple case $\mu_1=\mu_2=\ldots=\mu_k=1$ which is usually denoted as the joint kth-order cumulant, $c_{\underline{x}}=c(x_1,\ldots,x_k)$, of the random vector $\underline{x}$, i.e., the r.v.'s $x_1,\ldots,x_k$, is considered. It should be noted here that the kth-order means there are k random variables in the random vector $\underline{x}$.

One can derive the cumulant-to-moment formula based on the relationship described above. Let it be assumed that the numbers 1, 2, . . . , k are partitioned in different ways and that $n_p$ represents the number of groups in a partition p. If $g_1^P$ denotes the ith group of the pth partition, then the joint kth-order cumulant of the random vector is represented as a function of moments $$c(x_1,\ldots,x_K)=\sum_p(-1)^{n_p-1}(n_p-1)!E\left\{\prod_{i\in g_1^p}X_i\right\}\ldots E\left\{\prod_{i\in g_{n_p}^p}X_i\right\}$$

In this invention the real-time flame signal has been analyzed as a random process. The aim of analysis is to summarize the properties of a random signal, and to characterize its salient features.

To summarize the above explanation with respect to its application in the present invention, the characteristic function $\Phi_x$ of a random variable x (where x represents a signal) is defined as $$\Phi_x=E\{e^{j\omega x}\}=\int e^{j\omega x}f(x)dx.$$

Here, f(x) is the P.D.F. If the signal is a random (stochastic) signal (or process), and is characterized as ergodic and as stationary independent identically distributed (I.I.D.), then the HOS cumulant-to-moment formula can be derived as follows $$c(x_1,\ldots,x_K)=\sum_p(-1)^{n_p-1}(n_p-1)!E\left\{\prod_{i\in g_1^p}X_i\right\}\ldots E\left\{\prod_{i\in g_{n_p}^p}X_i\right\}$$

where k can be any integer number dependent upon the characters of the investigating random process and the function demands for certain specific applications. In the present invention, it is possible to set k arbitrarily large, to get more intermediate points. In the equation: (1) $c(x_1,\ldots,x_k)$ is the cumulant-to-moment formula for the signal represented by the random process (vector) X, having discrete random variables $(x_1,\ldots,x_k)$; (2) $E\{\Pi X_i\}$ represents the expectation value of the multiplication over groups 1 through n, with partitions p; and (3) $n_p$ is the number of groups in the specific partitions. Note that $X_i$ (where X is capitalized) represents a particular entire random process (vector) X having a given group of discrete random variables $(x_1,\ldots,x_k)$. Through investigation of flame signals produced from different kinds of fuels in the boiler, the HOS cumulants have the capabilities to describe significant characteristics of the flame signals as random processes.

The following explanation is provided to provide greater detail regarding the derivation of the cumulant-to-moment formula and its use for flame detection. As noted, the joint kth-order cumulant of the random process represented as a function of the moment (hereinafter referred to as cumulant-to-moment equation) is represented as $$c(x_1,\ldots,x_K)=\sum_p(-1)^{n_p-1}(n_p-1)!E\left\{\prod_{i\in g_1^p}X_i\right\}\ldots E\left\{\prod_{i\in g_n^p}X_i\right\}$$

The cumulants are useful and meaningful measures for using random variables in flame detection. A special case occurs when $X_m=X(n-m)$ for m=0, 1, 2, . . . n−1, and X(n) belongs to the discrete random process {X(n)}, which exists if $E\{|x(n)|^k\}<\infty$. This condition occurs if the signal X is a random process and has a zero mean. It is satisfied by most signals encountered in real-life, such as radiation wave signals used by photosensor devices for flame detection, because it is always possible to shift the signal such that the mean value (i.e., the expected value) equals zero.

By way of example, the third order cumulant sequence of random process is derived below. It should be noted that for higher-orders, the same approach applies. For k=3, the possible partitions of (1, 2, 3) are {(1, 2, 3)} (the first partition), {(1), (2, 3)} (the second partition), {(2), (1, 3)} (the third partition), {(3), (1, 2)} (the fourth partition), and {(1), (2), (3)} (the fifth partition). This means, in the above cumulant-to-moment equation: $n_p$ are $n_1=1$, $n_2=n_3=n_4=2$, $n_5=3$ for each possible partition.

Group theory can be applied to the partitions. The partition groups can be represented as the following groups:

$$g_1^1=\{X_1,X_2,X_3\},g_1^2=\{X_2,X_3\}g_1^3=\{X_2\}$$

$$g_2^3=\{X_1,X_3\},g_1^4=\{X_3\},g_2^4=\{X_1,X_2\}g_1^5=\{X_1\}$$

$$g_2^5=\{X_2\},g_3^5=\{X_3\}.$$

Therefore, the cumulant-to-moment equation can be represented as $$c(X_1,X_2,X_3)=E\{X_1X_2X_3\}-E\{X_1\}E\{X_2X_3\}-E\{X_2\}E\{X_1X_3\}-E\{X_3\}E\{X_1X_2\}+2E\{X_1\}E\{X_2\}E\{X_3\}$$

It can be assumed that $E\{X_i\}=0$ for i=1, 2, 3. It is possible to make the expected value, which is the mean value, equal to zero for the present application because it is possible to shift the signal such that the mean is zero. This is done before the cumulants are processed. Then the above equation is simplified as follows $$c(X_1,X_2,X_3)=E\{X_1X_2X_3\}$$

As alluded to, for a zero—mean random process, $X_m=X(n-m)$ for n=1, 2, . . . N; m=0, 1, 2 . . . n−1. By substituting arbitrary variables, the following relationships can be obtained: $X_1=X(n-m_1)$, $X_2=X(n-m_2)$ and $X_3=X(n-m_3)$. Letting $m_1=0$, $m_2=m_1$, and $m_3=m_2$, the above equation can be written as $$c_{3,x}(n,n-m_1,n-m_2)=E\{X(n)\cdot X(n-m_1)\cdot X(n-m_2)\}$$

for n=1,2,3, . . . N, $m_1$=0,1,2, . . . , n−1, and $m_2$=0,1,2, . . . , n−1.

Here, the subscript 3 represents the order of the cumulant, and the subscript variable X represents the random variable X.

If the investigated random process {X(n)} can be proved as a zero mean I.I.D. random process, then above equation can be simplified as follows:

$$c(n, n-m_1, n-m_2) = \sum_{n=1}^{N} X(n)X(n-m_1)X(n-m_2),$$

for $m_1$=0, 1, 2, n−1 and $m_2$=0, 1, 2, . . . , n−1.

Through an analogous derivation (which is almost the same as the above derivation), the following equation can be obtained:

$$c(n, n-m_1, n-m_2, n-m_3) = \sum_{n=1}^{N} X(n)X(n-m_1)X(n-m_2), X(n-m_3),$$

for $m_1$=0, 1, 2, . . . , n−1, $m_2$=0, 1, 2, . . . , n−1, and $m_3$=0, 1, 2, . . . , n−1. Hence, the cumulant can be obtained by shifting and multiplying individual values (discrete components) of random signals X, where the index represents time.

If the signal is strictly stationary as well, then $c(n,n-m_1, n-m_2)=c(m_1, m_2)$. Therefore, if the investigated random process {X(n)} is a zero mean, strictly stationary, I.I.D. random process, the cumulant can be represented as $$c(n, n-m_1, n-m_2) = c(m_1, m_2) = \sum_{n=1}^{N} x(n)x(n-m_1)x(n-m_2)$$

where $m_1$=0,1,2,3, . . . n−1, $m_2$=0,1,2, . . . n−1

The reason for taking the time variable n away from $c(n, n-m_1, n-m_2)$ is as follows: If the random signal is strictly stationary, or at least second order stationary, c becomes a variable depending upon shift points $m_1$ and $m_2$ (not origin point n), where $m_1$ and $m_2$ shift from 0 to n−1 for the entire data sequence of random process X. In the flame detection application, this is most often valid, because it is unlikely that the PDF of the random signal will change, or vary significantly with time.

It should be noted the above equations are specific forms of the general cumulant-to-moment equation:

$$c(x_1, \ldots, x_K) = \sum_{p} (-1)^{n_p-1}(n_p-1)!E\left\{\prod_{i\epsilon g_1^p} X_i\right\} \ldots E\left\{\prod_{i\epsilon g_{n_p}^p} X_i\right\}.$$

Aside from being used to reduce noise, particularly to remove Gaussian distributed noise, in the field of flame detection, the equation can also be used to boost the signal to noise ratio (SNR) of the random signal.

Figure 3:
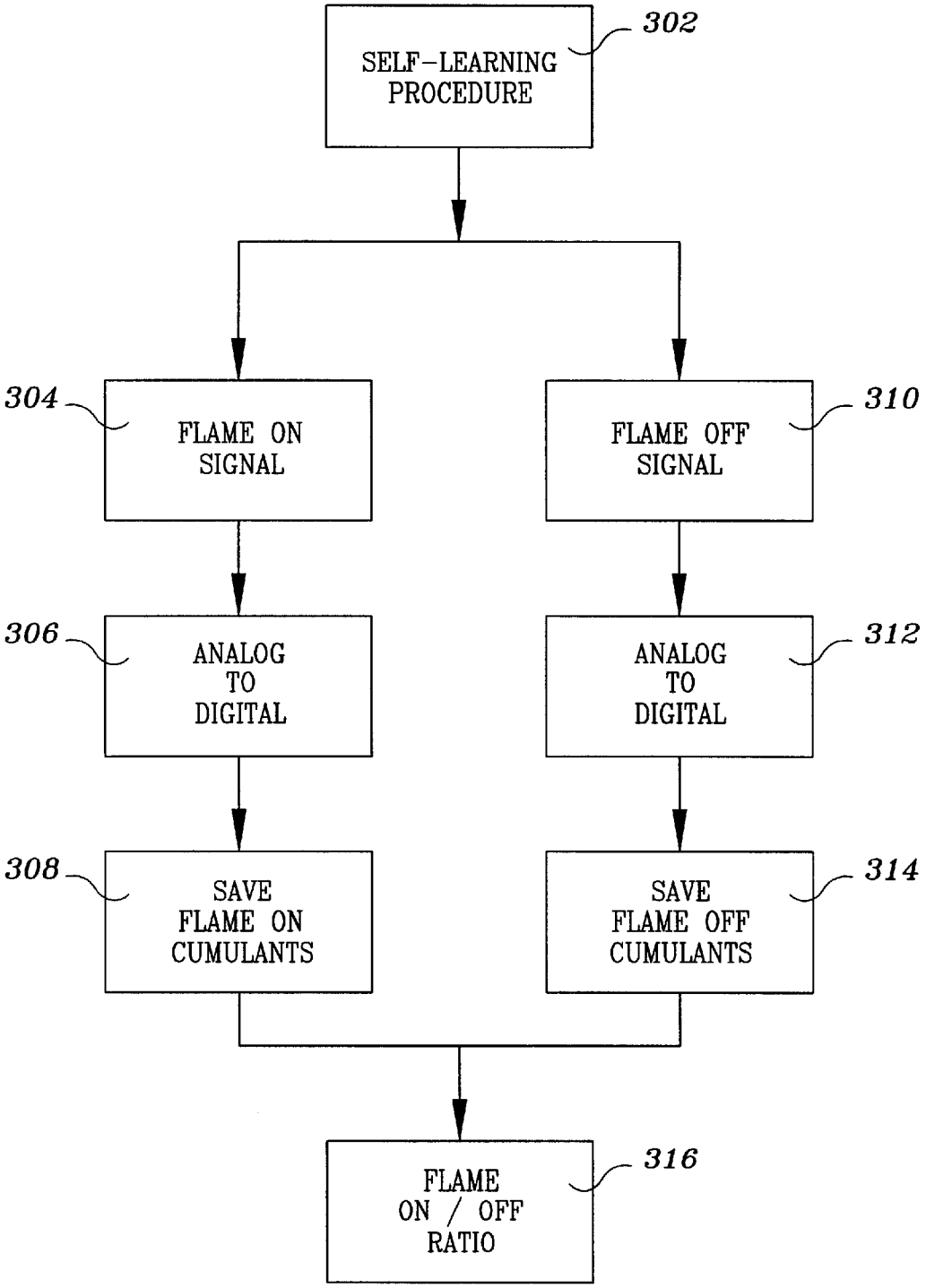
FIG. 3 illustrates a self-learning algorithm used to calculate and save flame on/off condition cumulants.

FIG. 3 illustrates a self-learning algorithm used to calculate and save flame on/off condition cumulants. The algorithm of FIG. 3 is used to detect flame on/off conditions (i.e., whether the flame is on or off) and to save the cumulants at these positions. Aside from removing Gaussian noises, another purpose for the present invention is to reduce or remove the background signal (noise) effects of adjacent burners. Unfortunately, the adjacent burners add background signal (noise) to the photosensor detecting a target burner, in the form of unwanted electromagnetic wavelengths which are superimposed on the wavelengths detected by the burner. Thus, during the steps of FIG. 3, the adjacent burners are left on, so that the cumulants stored from these steps reflect the effects of adjacent burners. The signal is detected and manipulated according to the description describing FIGS. 1, 2A, and 2B, so the following explanation should be read in view of the above descriptions.

In initial step 302, it is determined whether the burner is on or off. If the burner is on, control passes to step 304. At step 304, control passes to step 306, where the signal is digitized by an analog/digital converter. Following this, in step 308, the on/off conditions are detected. Specifically, the above cumulant-to-moment formula is applied to the signal, and the cumulants for the flame on signal are stored. Following step 308, in step 316, the information is added to information from step 314 to determine the flame on/off ratio, which is the ratio of time that the signal is on in comparison to the being off.

If in step 302 it is determined that the burner is off, then control passes to step 310. At step 310, control passes to step 312, where the signal is digitized by an analog/digital converter. Following this, in step 314, the on/off conditions are detected. Again, the above cumulant-to-moment formula is applied to the signal, and the cumulants for the flame off signal are stored. Following, step 314, in step 316, the information is added to information from step 308 to determine the flame on/off ratio.

The algorithm of FIG. 3 is a self-learning process. It can be applied multiple times to make the stored cumulants (in steps 308, 314) more and more accurate.

Figure 4:
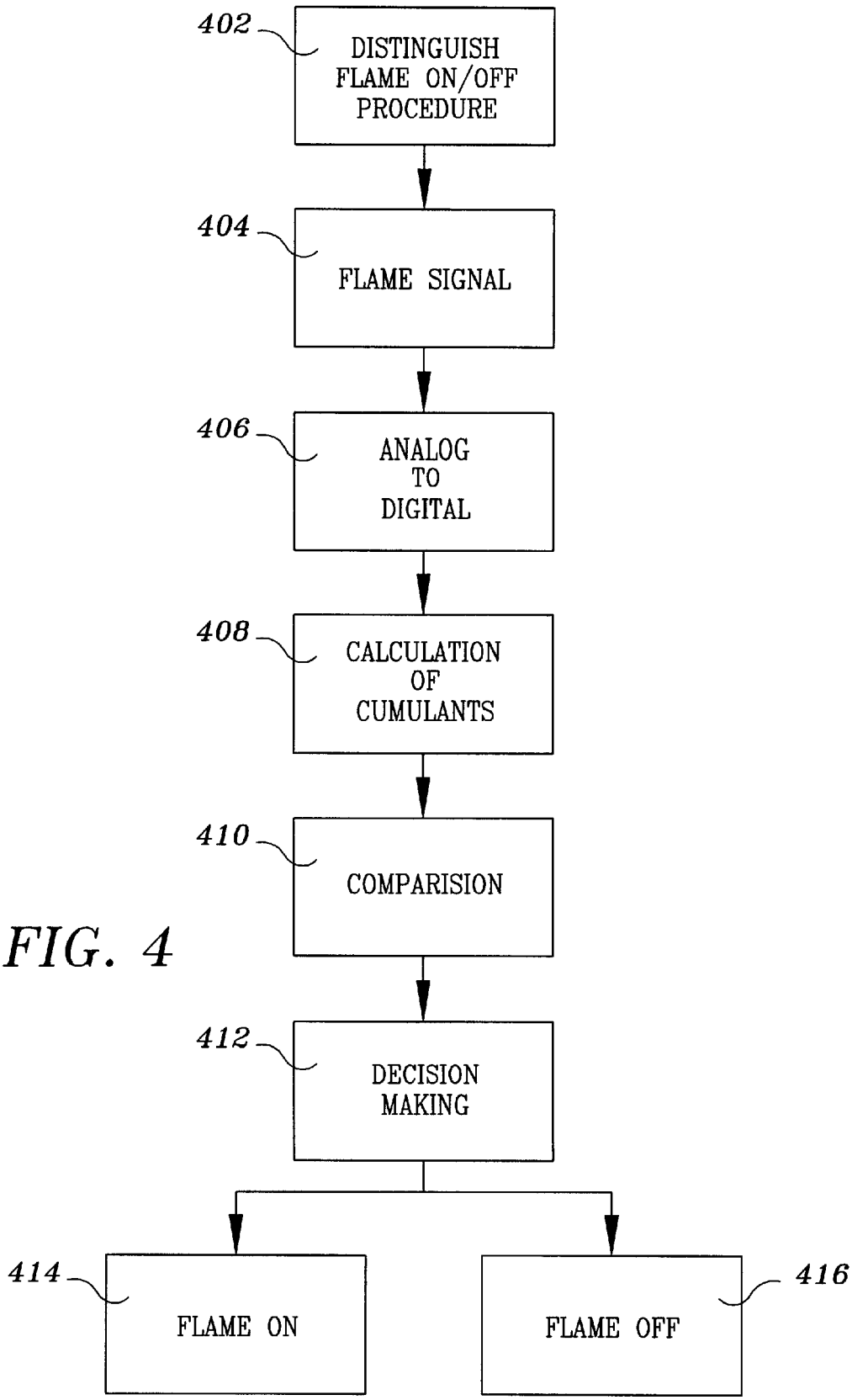
FIG. 4 illustrates an algorithm used to actually detect whether the flame is on or off, using the cumulants calculated and stored as shown in FIG. 3.

FIG. 4 illustrates an algorithm used to actually detect whether the flame is on or off, using the cumulants calculated and stored as shown in FIG. 3. After the introduction step 402, control passes to step 404.

In step 404, the flame signal is detected. Specifically, the radiation waves emitted from the burner are sensed by a photosensor 106, as illustrated with respect to FIG. 1.

Next, in step 406, the signal is converted from an analog signal into a digitized signal in step 406. This is also accomplished according to previously described methods.

In step 408, the cumulant for the detected signal are calculated using the above cumulants-to-moment equation. For uniformity, the cumulant(s) should be calculated the same way as the cumulants were calculated in steps 308 and 314. Those skilled in the art will recognize that the cumulants can be calculated a variety of ways, applying the above cumulant-to-moment formulas. For example, the cumulants can calculated for a third-order HOS, fourth-order HOS, etc., as desired for accuracy and implementation. Also, one or more cumulants can be calculated, as desired by the user. This similarly applies to the initial calculation of cumulants in steps 308, 314.

In step 410, the cumulant(s) are compared the cumulant(s) derived and stored in steps 308, 314, to determine whether the signal is on (step 414) or off (step 416). In one embodiment, the calculated cumulant is compared to a threshold cumulant value. In one embodiment, for example, the threshold cumulant value is derived as an intermediate value between the cumulant for the on signal (step 308) and the cumulant for the off signal (step 314). If the cumulant is above the threshold value, the flame is judged to be on, and control passes to step 414, where the condition is stored and used by a flame detection control apparatus. On the other hand, if the cumulant is below the threshold value, the flame is judged to be off, and control passes to step 416, where the condition is also stored and used by a flame detection control apparatus. The threshold value can be calculated in other ways, as recognized by those skilled in the relevant art, as by for example being weighted in an application specific manner between the cumulant of the off signal and the cumulant of the on signal.

FIG. 5 illustrates empirical results for a flame detection apparatus. Column 502 lists the test cases, numbered 1 through 4 for four test cases. The target burner 10 (the burner under observation) actually comprises a side burner 10B and a mid burner 10A. In this test, burners 10A and 10B are oil burners. Column 504 lists side burner 10B, whether it is judged to be on or off, and the test result cumulant value. Similarly, column 506 lists mid burner 10A, whether it is judged to be on or off, and the test result cumulant value. After burners 10A, 10B are two adjacent gas burners, namely burners 9B and 9A. The order of the burners was as follows: 10B, 10A, 9B, 9A. There are also additional burners located adjacent to these burners, which are not referenced or shown.

FIGS. 6A, 6B, 7A and 7B illustrate the cumulant spectrums for mid burner 10A, with shifted time domain shown as abscissa, and the cumulant shown as ordinate.

Figure 6A:
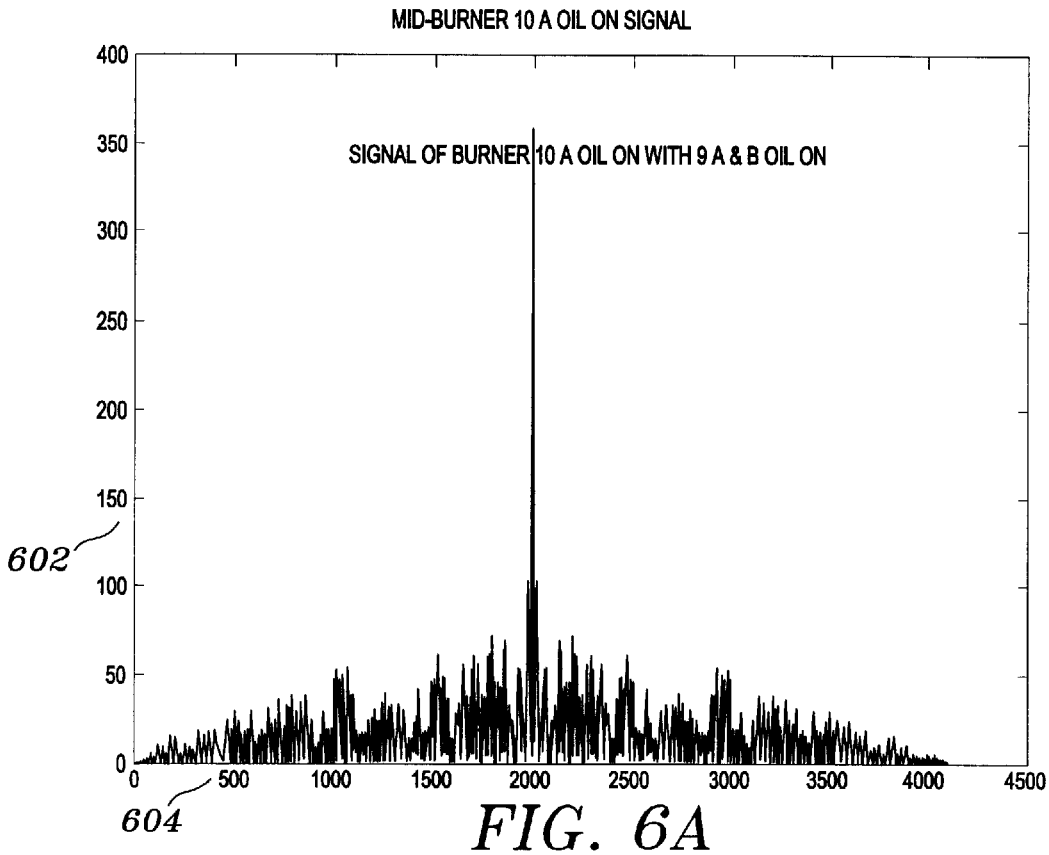
Figure 6B:
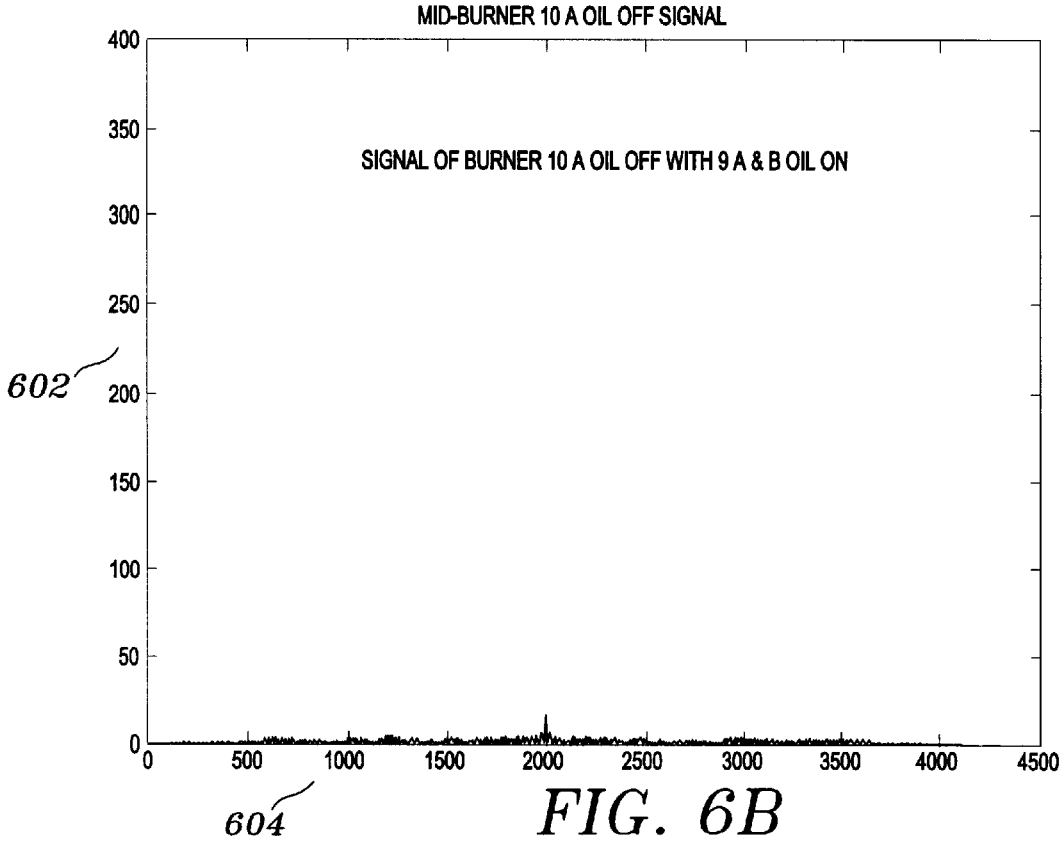

FIG. 6A illustrates the cumulant spectrum for mid burner 10A on, with adjacent oil burners 9A and 9B on. FIG. 6B illustrates the cumulant spectrum for mid burner 10A off, with adjacent oil burners 9A and 9B similarly on. The abscissa indicating shifted time domain is labeled 604, and the ordinate indicating cumulant is labeled 602.

Figure 7A:
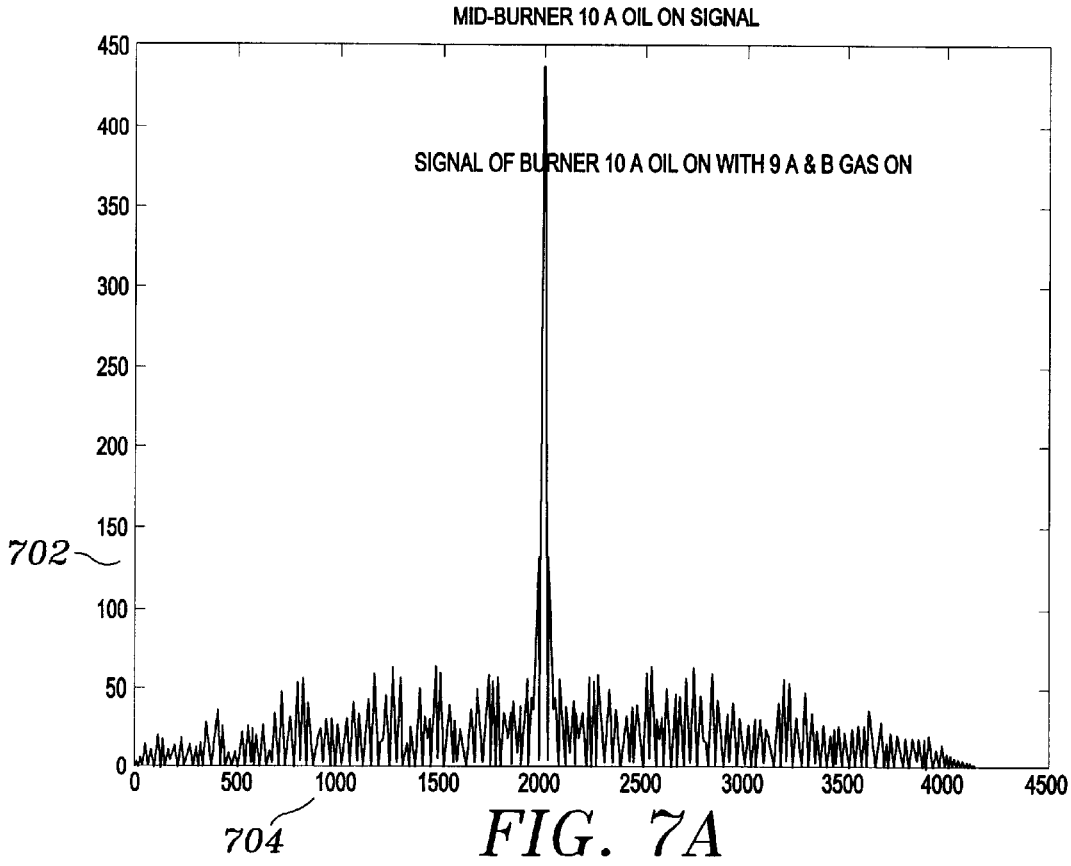
Figure 7B:
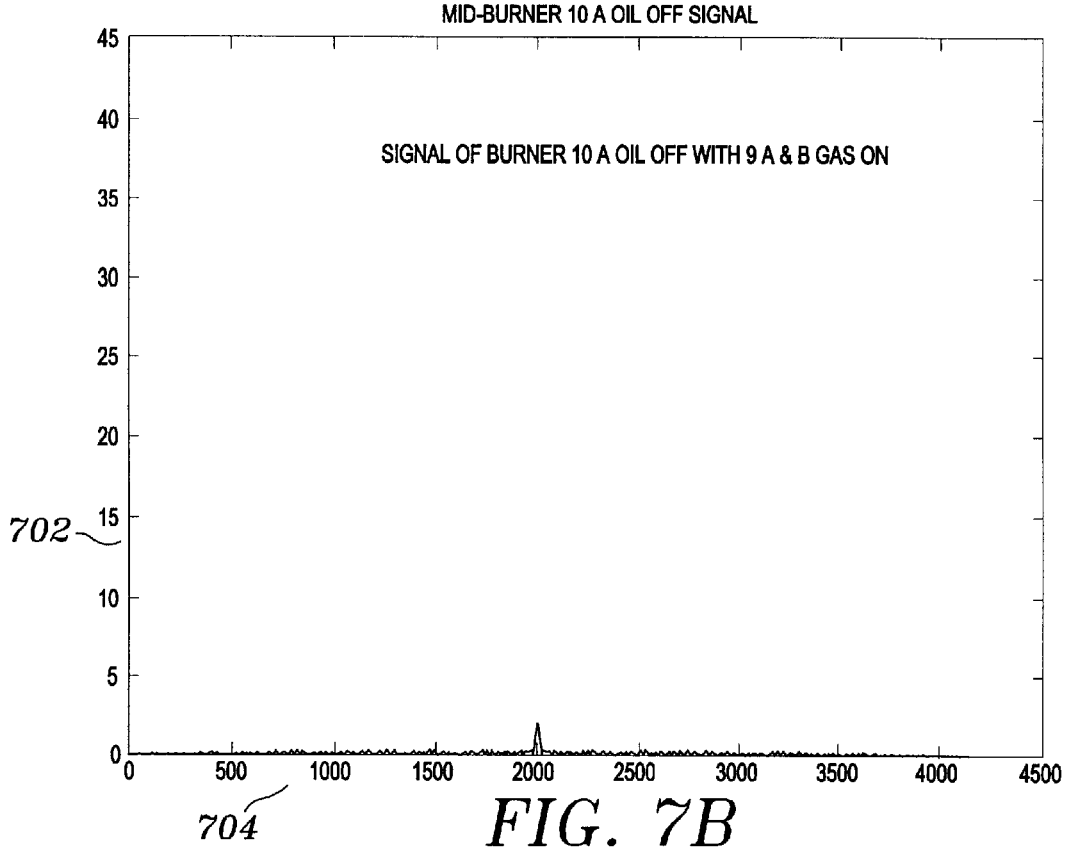

FIGS. 7A and 7B differ from FIGS. 6A and 6B only in that the adjacent burners 9A and 9B are now gas burners (not oil burners). Hence, FIG. 7A illustrates the cumulant spectrum for mid burner 10A on, with adjacent gas burners 9A and 9B on, and FIG. 7B illustrates the cumulant spectrum for mid burner 10A off, with adjacent gas burners 9A and 9B similarly on. The abscissa indicating shifted time domain is labeled 704, and the ordinate indicating cumulant is labeled 702.

While the invention has been particularly shown and described with reference to preferred embodiments thereof, it will be understood by those skilled in the relevant art that various changes in form and details may be made therein without departing from the spirit and scope of the invention.

What is claimed is:

1. A method for detecting whether a flame is an on state or alternatively is in an off state, comprising:

(i) detecting the flame and generating therefrom a flame signal capturing one or more attributes of the flame;

(ii) using a high-order cumulant-to-moment formula to determine one or more high-order cumulants for a random variable process representation of the flame signal; and (iii) determining whether the flame is on or off using said one or more high-order cumulants.

2. The method according to claim 1, further comprising:

applying said high-order cumulant-to-moment formula in a self-learning algorithm to determine one or more flame-on high-order cumulants and one or more flame-off high-order cumulants for the flame.

3. The method according to claim 2, comprising:

detecting a second flame signal, wherein an on or off status of a flame from which said second flame signal is obtained is known;

converting said second flame from an analog form flame signal to a digitized form flame signal; and determining said one or more flame-on high-order cumulants and said one or more flame-off high-order cumulants from said digitized form flame signal.

4. The method according to claim 2, wherein step (i) comprises:

detecting said flame signal wherein an on or off status of the flame is unknown; and converting said flame signal from an analog form flame signal to a digitized form flame signal.

5. The method according to claim 4, wherein detecting of said flame signal comprises:

optically detecting wavelengths of radiation emitted by the flame.

6. The method according to claim 4, wherein step (ii) comprises calculating said high-order cumulants from said digitized form flame signal.

7. The method according to claim 2, wherein step (iii) comprises:

comparing said one or more high-order cumulants to said flame-on high-order cumulants and said flame-off high-order cumulants to determine whether the status of the flame is on or off.

8. The method according to claim 7, wherein step (iii) comprises:

determining one or more threshold cumulants located between said flame-on high-order cumulants and said flame-off high-order cumulants; and comparing said one or more high-order cumulants to said one or more threshold cumulants to determine whether the status of the flame is on or off.

9. The method according to claim 1, wherein said cumulant-to-moment formula comprises the equation:

$$c(x_1, \ldots, x_K) = \sum_p (-1)^{n_p-1}(n_p-1)!E\left\{\prod_{i\in g_i^p} X_i\right\} \ldots E\left\{\prod_{i\in g_{n_p}^p} X_i\right\}$$

wherein $c(x_1, \ldots, x_k)$ represents cumulants, wherein $(x_1, \ldots, x_k)$ represent k discrete random variables of a digitized random process (vector), wherein p represents partitions, wherein $n_p$ represents the number of groups in the specific partition, wherein E{ } represents an expectation, wherein i represents an integer, wherein $X_i$ represents an ith random process, wherein g represents a group in one specific partition, wherein $g_i^p$ through $g_n^p$ represent the ith through the $n_p$th partition groups.

10. The method according to claim 1, wherein the flame arises from combustion of a fuel in a burner associated with a boiler, and wherein said fuel comprises any one of:

oil fuel;

gas fuel; and coal fuel.

11. A system for detecting whether a flame is an on state or alternatively is in an off state, comprising:

device that detects the flame and generates therefrom a flame signal capturing one or more attributes of the flame;

device that uses a high-order cumulant-to-moment formula to determine one or more high-order cumulants for a random variable process representation of the flame signal; and device that determines whether the flame is on or off using said one or more high-order cumulants.

12. The system according to claim 11, further comprising:

device that applies said high-order cumulant-to-moment formula in a self-learning algorithm to determine one or more flame-on high-order cumulants and one or more flame-off high-order cumulants for the flame.

13. The system according to claim 12, comprising:

device that detects a second flame signal, wherein an on or off status of a flame from which said second flame signal is obtained is known;

device that converts said second flame from an analog form flame signal to a digitized form flame signal; and device that determines said one or more flame-on high-order cumulants and said one or more flame-off high-order cumulants from said digitized form flame signal.

14. The system according to claim 12, wherein said device that detects the flame and generates therefrom a flame signal capturing one or more attributes of the flame comprises:

device that detects said flame signal wherein an on or off status of the flame is unknown; and device that converts said flame signal from an analog form flame signal to a digitized form flame signal.

15. The system according to claim 14, wherein said device that detects said flame signal comprises:

device that optically detects wavelengths of radiation emitted by the flame.

16. The system according to claim 14, wherein said device that uses a high-order cumulant-to-moment formula to determine one or more high-order cumulants for a random variable process representation of the flame signal comprises:

device that calculates said high-order cumulants from said digitized form flame signal.

17. The system according to claim 12, wherein said device that determines said one or more flame-on high-order cumulants and said one or more flame-off high-order cumulants from said digitized form flame signal comprises:

device that compares said one or more high-order cumulants to said flame-on high-order cumulants and said flame-off high-order cumulants to determine whether the status of the flame is on or off.

18. The system according to claim 17, wherein said device that determines said one or more flame-on high-order cumulants and said one or more flame-off high-order cumulants from said digitized form flame signal comprises:

device that determines one or more threshold cumulants located between said flame-on high-order cumulants and said flame-off high-order cumulants; and device that compares said one or more high-order cumulants to said one or more threshold cumulants to determine whether the status of the flame is on or off.

19. The system according to claim 11, wherein said cumulant-to-moment formula comprises the equation:

$$c(x_1, \ldots, x_K) = \sum_p (-1)^{n_p-1}(n_p-1)!E\left\{\prod_{i\in g_1^p} X_i\right\} \ldots E\left\{\prod_{i\in g_{n_p}^p} X_i\right\}$$

wherein $c(x_1, \ldots, x_k)$ represents cumulants, wherein $(x_1, \ldots, x_k)$ represent k discrete random variables of a digitized random process (vector), wherein p represents partitions, wherein $n_p$ represents the number of groups in the specific partitions, wherein E{ } represents an expectation, wherein i represents an integer, wherein $X_i$ represents an ith random process, wherein g represents a group in one specific partition, wherein $g_i^p$ through $g_n^p$ represent the ith through the $n_p$th partition groups.

20. The system according to claim 11, wherein the flame arises from combustion of a fuel in a burner associated with a boiler, and wherein said fuel comprises any one of:

oil fuel;

gas fuel; and coal fuel.

* * * * *

UNITED STATES PATENT AND TRADEMARK OFFICE

CERTIFICATE OF CORRECTION

PATENT NO. : 6,261,086 B1
DATED : July 17, 2001
INVENTOR(S) : Zhizhen Fu

It is certified that error appears in the above-identified patent and that said Letters Patent is hereby corrected as shown below:

Column 3,
Line 31, delete "all" and substitute therefor -- art --.

Column 4,
Line 22, delete "110" and substitute therefor -- 102 --.
Line 30, delete "10O".

Column 6,
Line 10, delete "$c_x^{(10)}$" and substitute therefor -- $c_x^{(0)}$ --.
Line 43, delete "(ω)" and substitute therefor -- (ω) --.

Column 9,
Line 6, following "0,1,2," insert -- ..., --.

Signed and Sealed this

Nineteenth Day of February, 2002

*Attest:*

*Attesting Officer*

JAMES E. ROGAN
*Director of the United States Patent and Trademark Office*